US009222725B2

(12) United States Patent
Prosser et al.

(10) Patent No.: US 9,222,725 B2
(45) Date of Patent: Dec. 29, 2015

(54) AIR SEPARATION METHOD AND APPARATUS

(75) Inventors: Neil Mark Prosser, Lockport, NY (US); Richard John Jibb, Amherst, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 2573 days.

(21) Appl. No.: 11/818,636

(22) Filed: Jun. 15, 2007

(65) Prior Publication Data

US 2008/0307828 A1 Dec. 18, 2008

(51) Int. Cl.
*F25J 3/04* (2006.01)
*F25J 5/00* (2006.01)

(52) U.S. Cl.
CPC ..... *F25J 3/04187* (2013.01); *F25J 3/0409* (2013.01); *F25J 3/04084* (2013.01); *F25J 3/04218* (2013.01); *F25J 3/04236* (2013.01); *F25J 3/04303* (2013.01); *F25J 3/04387* (2013.01); *F25J 3/04412* (2013.01); *F25J 3/04678* (2013.01); *F25J 5/00* (2013.01); *F25J 3/0423* (2013.01); *F25J 2240/10* (2013.01); *F25J 2290/12* (2013.01); *F25J 2290/32* (2013.01)

(58) Field of Classification Search
CPC . F25J 3/0409; F25J 3/04187; F25J 3/304218; F25J 3/0423; F25J 5/002; F25J 3/04236; F25J 3/04339; F25J 3/04296; F25J 3/04303; F25J 3/04387; F25J 3/04412; F25J 3/04678; F25J 2290/32
USPC ..... 62/640, 643–650, 652, 653
See application file for complete search history.

(56) References Cited

U.S. PATENT DOCUMENTS

| | | | | |
|---|---|---|---|---|
| 3,661,203 | A * | 5/1972 | Mesher | 165/167 |
| 4,279,631 | A | 7/1981 | Skolaude | |
| 4,345,925 | A | 8/1982 | Cheung | |
| 4,372,764 | A | 2/1983 | Theobald | |
| 5,106,398 | A * | 4/1992 | Dunn et al. | 62/643 |

(Continued)

FOREIGN PATENT DOCUMENTS

| | | | |
|---|---|---|---|
| DE | 10 2005 028 012 | A1 | 9/2006 |
| JP | S58194711 | A | 11/1983 |
| JP | 2005265392 | A | 9/2005 |

OTHER PUBLICATIONS

Springmann, "The Production of High-Pressure Oxygen", Linde Reports on Science and Technology, 1980, No. 31.

(Continued)

*Primary Examiner* — John F Pettitt
(74) *Attorney, Agent, or Firm* — Robert J. Hampsch; David M. Rosenblum

(57) ABSTRACT

A compressed air stream is cooled to a temperature suitable for its rectification within a lower pressure heat exchanger and a boosted pressure air stream is liquefied or converted to a dense phase fluid within a higher pressure heat exchanger in order to vaporize pumped liquid products. Thermal balancing within the plant is effectuated with the use of waste nitrogen streams that are introduced into the higher and lower pressure heat exchangers. The heat exchangers are configured such that the flow area for the subsidiary waste nitrogen stream within the higher pressure heat exchanger is less than that would otherwise be required so that the subsidiary waste nitrogen streams were subjected to equal pressure drops in the higher and lower pressure heat exchangers. This allows the higher pressure heat exchanger be fabricated with a reduced height and therefore a decrease in fabrication costs.

14 Claims, 4 Drawing Sheets

(56) References Cited

U.S. PATENT DOCUMENTS

| | | | | | |
|---|---|---|---|---|---|
| 5,197,296 | A | | 3/1993 | Prosser et al. | |
| 5,337,571 | A | | 8/1994 | Ducrocq et al. | |
| 5,355,681 | A | * | 10/1994 | Xu | 62/646 |
| 5,355,682 | A | * | 10/1994 | Agrawal et al. | 62/646 |
| 5,655,388 | A | | 8/1997 | Bonaquist et al. | |
| 5,711,166 | A | * | 1/1998 | Mehta et al. | 62/650 |
| 5,829,271 | A | * | 11/1998 | Lynch et al. | 62/646 |
| 5,916,262 | A | * | 6/1999 | Prosser et al. | 62/646 |
| 6,286,336 | B1 | * | 9/2001 | Prosser | 62/648 |
| 6,293,126 | B1 | | 9/2001 | Higginbotham | |
| 6,321,568 | B1 | * | 11/2001 | Lehman | 62/654 |
| 6,357,258 | B1 | * | 3/2002 | Mahoney et al. | 62/643 |
| 6,360,561 | B2 | | 3/2002 | Allam et al. | |
| 6,430,962 | B2 | | 8/2002 | Miura et al. | |
| 6,622,520 | B1 | * | 9/2003 | Prosser et al. | 62/646 |
| 6,626,008 | B1 | * | 9/2003 | Prosser et al. | 62/654 |
| 6,629,433 | B2 | | 10/2003 | Corduan et al. | |
| 6,718,795 | B2 | | 4/2004 | Briglia | |
| 7,188,492 | B2 | | 3/2007 | Corduan et al. | |
| 2001/0050162 | A1 | * | 12/2001 | Valenzuela | 165/80.4 |
| 2006/0169000 | A1 | | 8/2006 | Judas | |
| 2011/0192194 | A1 | * | 8/2011 | Howard | 62/644 |

OTHER PUBLICATIONS

The Brazed Aluminium Plate-Fin Heat Exchanger Manufacturers' Association (ALPEMA)—www.alpema.org; "The Standards of the Brazed Aluminium Plate-Fin Heat Exchanger Manufacturers' Association"; Second Edition 2000; Chapter 7 Thermal and Hydraulic Design; p. 53.

* cited by examiner

AIR SEPARATION METHOD AND APPARATUS

FIELD OF THE INVENTION

The present invention relates to a method and apparatus for separating air into nitrogen and oxygen-rich products by cryogenic distillation in which the air, after having been compressed and purified, is cooled to a temperature suitable for its distillation through indirect heat exchange with the nitrogen and oxygen-rich products within heat exchangers. More particularly, the present invention relates to such a method and apparatus in which a liquid oxygen stream is pumped and then vaporized in a separate heat exchanger through indirect heat exchange with part of the air that has been further compressed in a booster compressor.

BACKGROUND OF THE INVENTION

It is well known in the art to separate air into nitrogen and oxygen-rich products and also potentially an argon-rich product by cryogenic distillation. In accordance with such method, the air is compressed and purified and then cooled to a temperature suitable for its distillation within a heat exchanger against return streams that comprise the nitrogen and oxygen-rich products.

The separation of the air into the oxygen and nitrogen-rich products takes place within an air separation unit having higher and lower pressure columns that are operatively associated with one another in a heat transfer relationship, typically by a condenser-reboiler located at the bottom of the lower pressure column. The incoming air is rectified within the higher pressure column to produce a crude liquid oxygen column bottoms and a nitrogen column overhead that is condensed by the condenser-reboiler to reflux the higher pressure column. A stream of the nitrogen-rich liquid is also introduced into the top of the low pressure column to reflux the lower pressure column. A stream of the crude liquid oxygen is also introduced into the lower pressure column for further refinement and to produce an oxygen-rich liquid column bottoms in the lower pressure column that is vaporized by the condenser-reboiler. A waste nitrogen stream is withdrawn below the top of the lower pressure column together with a nitrogen-rich vapor column overhead that are introduced into a heat exchanger to cool the incoming air.

It is known to produce a high pressure oxygen product by pumping a liquid oxygen stream that is composed by the oxygen-rich liquid column bottoms and then vaporizing it in a heat exchanger against a stream of the compressed and purified air that has been further compressed by a booster compressor. The boosted pressure stream of air either liquefies or is converted into a dense phase fluid against vaporizing the pressurized liquid oxygen stream to produce the high pressure oxygen product. Additionally, it is also known that a nitrogen product composed of the nitrogen-rich liquid produced in the higher pressure column can also be pumped and vaporized in a like manner.

As mentioned above, an argon product can also be separated by withdrawing an argon-rich vapor stream from the lower pressure column and rectifying it in an argon column. The resulting liquid column bottoms is returned to the lower pressure column. The argon column is refluxed by condensing argon-rich column overhead in a condenser through indirect heat exchange with all or part of the crude-liquid oxygen stream before its introduction into the lower pressure column.

Although the above process and apparatus can utilize a single, main heat exchanger for cooling the incoming air streams through indirect heat exchange with the return streams that contain the oxygen-rich and nitrogen-rich products as well as the pressurized, pumped oxygen stream, it is also known to separately vaporize the pressurized oxygen product within a separate high pressure heat exchanger. Such process and apparatus are shown in Linde Reports on Science and Technology, "The Production of High-Pressure Oxygen", Springmann (1980). In this paper it is also illustrated to utilize the waste nitrogen stream after having been used in subcooling duty as a feed to both the higher pressure heat exchanger that is used in vaporizing the pressurized and pumped liquid oxygen and also as a feed to the other heat exchanger that operates at a lower pressure to cool the main air stream to a temperature suitable for its rectification. This waste nitrogen feed to the heat exchangers is necessary for thermal balancing purposes. By "thermal balancing" what is meant is that the waste nitrogen streams decrease the difference between warm end temperatures of the streams exiting the lower pressure heat exchanger and the higher pressure heat exchanger to inhibit warm end losses of refrigeration by such heat exchangers and also to decrease the temperature difference of the boosted-pressure air stream and the main air stream at the cold end of the high pressure heat exchanger and the low pressure heat exchanger. In this way, the temperature difference between the boosted-pressure air stream and the pumped liquid oxygen stream at the cold end of the higher pressure heat exchanger can be optimized. It is advantageous to decrease the temperature difference at the cold end of the higher pressure heat exchanger in that the boosted pressure air liquefies within such heat exchanger and then thereafter, must be expanded for its introduction into at least the lower pressure column but also, potentially, the higher pressure column. If the temperature of this stream is too warm, vapor will evolve from the boosted pressure air during the expansion to effect the requisite distillation of the air to produce the desired products.

Brazed aluminum heat exchangers are used from both the higher and lower pressure heat exchangers. Such heat exchangers have a layered construction in which each of the streams, for example the incoming air stream, the nitrogen-rich stream and etc. pass through separate layers that are arranged in a pattern to efficiently conduct indirect heat exchange between the streams. The layered construction is produced in such heat exchangers by a series of parallel parting plates and peripheral side bars to seal the layers along their edges. Manifolds are provided to feed the streams into the layers. An arrangement of fins is provided in each of the layers that increase the area available for the heat exchange.

As can be appreciated, a high pressure heat exchanger for pumped liquid oxygen service in which typically the oxygen is to be supplied at 450 psia require air at a pressure of 1100 psia to vaporize the oxygen. Heat exchangers designed to handle such high pressures are more expensive than heat exchangers designed for lower pressure duty. For example, in case of brazed aluminum plate-fin heat exchangers, such heat exchangers require the use of reduced cross-sectional areas, have a very limited selection of heat transfer fins and require thicker design elements such as parting sheets and side bars as compared with a heat exchanger that operates at a lower pressure. All of this increases the cost of such heat exchangers that are designed to operate at high operational pressures such as is the case where a pressurized, pumped liquid oxygen stream is to be vaporized. Thicker materials and other known considerations would increase the costs of other types of heat exchangers such as like spiral wound, printed circuit and stainless steel plate-fin heat exchangers.

A spiral-wound heat exchanger is in general a tubular heat exchanger, wherein copper or aluminum tubes are wound round a central mandrel. The tubes and mandrel are enclosed in a pressure vessel shell. Each tube starts and ends in one of several tubesheets which are connected through the pressure vessel shell to headers. There will be one inlet and one outlet header for each stream in the heat exchanger.

If the operating pressure is high, these exchangers must utilize thicker tube walls to contain the pressure, which increases the quantity of material required. Hence spiral wound heat exchangers are more expensive if required to operate at higher pressure. Diffusion-bonded heat exchangers are constructed from flat metal plates into which fluid flow channels are either chemically etched or pressed.

Plates are then stacked and diffusion-bonded together by pressing metal surfaces together at temperatures below the melting point, to form a block. The blocks are then welded together to form the complete heat exchange core. Headers and nozzles are welded to the core in order to direct the fluids to the appropriate sets of passages. Design pressures up to 600 bara can be accommodated.

Higher design pressures are achieved in a printed circuit heat exchanger at the expense of smaller channels with thicker walls. To achieve the same pressure drop and heat transfer duty more material will be required—hence the heat exchanger is more expensive.

As will be discussed among other advantages of the present invention, a method and apparatus is provided for separating air in which fabrication costs of the higher pressure heat exchanger can be reduced by decreasing its size.

SUMMARY OF THE INVENTION

In one aspect, the present invention relates to a method of separating air. In accordance with the method, a first compressed and purified air stream and a second compressed and purified air stream are produced. The second compressed and purified air stream has a higher pressure than the first compressed and purified air stream. The first compressed and purified air stream and the second compressed and purified air stream are cooled in a lower pressure heat exchanger and a higher pressure heat exchanger, respectively, through indirect heat exchange with return streams generated in an air separation unit, thereby to produce a main feed air stream and a high pressure air stream that is either in a liquid or dense phase fluid state. In this regard, the term, "return streams" as used herein and in the claims means the oxygen-rich and nitrogen-rich streams that are separated from the air by rectification within the air separation unit. Additionally, the term "heat exchanger" means as used herein and in the claims either a single unit or a series of such units in parallel.

The main feed air stream is introduced into a higher pressure column of the air separation unit. The high pressure air stream is expanded and introduced at least in part into at least one of the lower pressure column or the higher pressure column of the air separation unit. The return streams comprise at least part of a pumped liquid oxygen stream composed of a liquid oxygen column bottoms of the lower pressure column that is introduced into the higher pressure heat exchanger and vaporized. Additionally, return streams also comprise first and second subsidiary waste nitrogen streams that are formed from a waste nitrogen stream removed from the lower pressure column. The first and second subsidiary waste nitrogen streams are introduced into the higher pressure heat exchanger and the lower pressure heat exchanger, respectively, for thermal balance purposes. As used herein and in the claims, the term "thermal balance purposes" means the minimization of the temperature of the streams entering and exiting the warm end of the lower pressure heat exchanger and the temperature differences of the main feed air stream and the high pressure air stream being discharged from the cold end of the higher pressure heat exchanger and the lower pressure heat exchanger, respectively. In this way, the temperature difference between the boosted-pressure air stream and the pumped liquid oxygen stream at the cold end of the higher pressure heat exchanger can be optimized. As indicated above, divergence of temperatures at the warm end of the lower pressure heat exchanger will produce warm end losses of refrigeration and such divergence in temperature at the cold end of the higher pressure heat exchanger will result in the liquid air evolving into an undesirable high vapor fraction upon its expansion that will upset the intended distillation to be carried out in the air separation unit.

The higher and lower pressure heat exchangers are configured such that the first subsidiary waste nitrogen stream undergoes a higher pressure drop in the higher pressure heat exchanger than the second subsidiary waste nitrogen stream in the lower pressure heat exchanger. This is accomplished by passing the first subsidiary waste nitrogen stream through a smaller cross-sectional flow area than would otherwise be required to produce a pressure drop in the first subsidiary waste nitrogen stream equal to that of the second subsidiary waste nitrogen stream in the lower pressure heat exchanger.

If for example, the higher pressure heat exchanger were made of plate-fin construction and used a higher cross-sectional flow area for the first subsidiary waste nitrogen stream, thicker parting sheets and side bars would otherwise be required with the result in increased fabrication costs over the heat exchanger being contemplated by the present invention. By passing the first subsidiary waste nitrogen stream through a smaller cross-sectional area its velocity will increase resulting in the higher pressure drop. However, small cross-sectional flow area will also reduce the number of layers of a plate-fin heat exchanger that are required for heat exchange of the first subsidiary waste nitrogen stream within the higher pressure heat exchanger. Since less layers are used, in case of a plate-fin heat exchanger, the height of the higher pressure heat exchanger can be reduced to reduce its fabrication costs.

An air stream can be compressed, cooled and purified. The air stream is purified in a purification unit having an adsorbent to adsorb higher boiling impurities in the air stream. The first compressed and purified air stream can be formed from a first part of the air stream after having been compressed, cooled and purified. The second compressed and purified air stream can be formed by further compressing and cooling a second part of the air stream after having been compressed, cooled and purified. The adsorbent in the purification unit is regenerated with a second of the first and second waste nitrogen streams having passed through the lower pressure heat exchanger. Thus, since the second of the waste nitrogen streams is at a higher pressure, it is capable of serving such regeneration duties. Thus, nothing is lost by allowing the first subsidiary waste nitrogen stream to undergo the higher pressure drop in the higher pressure heat exchanger.

A third part of the air stream after having been compressed, cooled and purified can be further compressed and then partially cooled within the lower pressure heat exchanger. Thereafter, it can be turboexpanded within a turboexpander to generate a refrigeration stream and therefore refrigeration for the process. The refrigeration stream can be introduced into the lower pressure column. Alternatively, a third part of the air stream after having been compressed, cooled and purified can be further compressed and cooled and then partially cooled within the higher pressure heat exchanger. Thereafter it can be turboexpanded within a turboexpander to generate a refrigeration stream and then introduced into the lower pressure column.

In any embodiment of the present invention, a crude liquid oxygen stream composed of liquid column bottoms of the higher pressure column and a nitrogen-rich liquid stream composed of liquefied nitrogen column overhead of the higher pressure column can be subcooled through indirect heat exchanger with the waste nitrogen stream and a nitrogen-rich vapor stream composed of column overhead of the lower pressure column. At least part of the crude liquid oxygen stream and at least part of the nitrogen-rich liquid stream are expanded and introduced into the lower pressure column. The nitrogen-rich vapor stream is introduced into the lower pressure heat exchanger as one of the return streams. Where refrigeration is generated in the lower pressure heat exchanger, a crude liquid oxygen stream composed of liquid column bottoms of the higher pressure column and nitrogen-rich liquid stream composed of liquefied nitrogen column overhead of the higher pressure column can be subcooled within the lower pressure heat exchanger. At least part of the liquid oxygen stream and at least part of the nitrogen-rich liquid stream are expanded and introduced in the lower pressure column. The nitrogen-rich vapor stream is introduced into the lower pressure heat exchanger as one of the return streams. In such embodiment, the nitrogen-rich liquid stream can be a first nitrogen-rich liquid stream and a second nitrogen-rich liquid stream composed of the liquefied nitrogen column overhead of the higher pressure column can be pumped and vaporized within the higher pressure heat exchanger.

In another aspect, the present invention provides an air separation apparatus. In accordance with this aspect of the invention, a main air compressor, a first after-cooler and a purification unit can be provided to compress, cool and purify an air stream. This produces a first compressed and purified air stream from a first part of the air stream after having been compressed, cooled and purified. A booster compressor, provided in flow communication with the purification unit, can further compress a second part of the air stream after having been compressed, cooled and purified and a second after-cooler can be connected to the booster compressor to cool the second part of the air stream. This forms a second compressed and purified air stream having a higher pressure than the first compressed and purified air stream. A higher pressure heat exchanger and a lower pressure heat exchanger are provided. The higher pressure heat exchanger is connected to the second after-cooler. The lower pressure heat exchanger is in flow communication with the purification unit. Each of the higher pressure heat exchanger and the lower pressure heat exchanger are of brazed aluminum construction.

The higher pressure heat exchanger and the lower pressure heat exchanger can be configured to cool the first compressed and purified air stream and the second compressed and purified air stream, respectively, through indirect heat exchange with return streams generated in an air separation unit, thereby to produce a main feed air stream and a high pressure air stream that is either in a liquid or a dense phase fluid state. The air separation unit comprises a higher pressure column connected to the lower pressure heat exchanger to receive the main feed air stream and a lower pressure column connected to the higher pressure heat exchanger by an expansion device to receive at least part of the high pressure air stream.

A pump can be provided to pressurize a liquid oxygen stream composed of a liquid oxygen column bottoms of the lower pressure column. The pump is connected to the higher pressure heat exchanger so that the liquid oxygen stream after having been pumped is introduced into the higher pressure heat exchanger and vaporized. The higher pressure heat exchanger and the lower pressure heat exchanger are also in flow communication with the lower pressure column to receive first and second subsidiary waste nitrogen streams, respectively. The first and second subsidiary nitrogen streams are formed from a waste nitrogen stream removed from the lower pressure column, for thermal balance purposes. The higher pressure heat exchanger is configured such that a smaller cross-sectional flow area for the first subsidiary waste nitrogen stream exists within the higher pressure heat exchanger than would otherwise be required to produce a pressure drop in the first subsidiary waste nitrogen stream equal to that of the second subsidiary waste nitrogen stream in the lower pressure heat exchanger. Again, as outlined above, this allows the higher pressure heat exchanger to be fabricated in a less expensive manner.

The purification unit can be provided with an adsorbent to adsorb higher boiling impurities in the air stream. The purification unit is connected to the lower pressure heat exchanger so as to receive the second of the first and second waste nitrogen streams after having passed through the lower pressure heat exchanger to regenerate the adsorbent.

A further booster compressor can also be provided in flow communication with a purification unit to further compress a third part of the air stream and a third after-cooler is connected to the further booster compressor. The lower pressure heat exchanger is connected to the further booster compressor and is configured to partially cool the third part of the air stream after having been further compressed. The turboexpander is connected between the lower pressure heat exchanger and the lower pressure column so as to turboexpand the third part of the air stream. This forms a refrigeration stream that is introduced into the lower pressure column. Alternatively, the higher pressure heat exchanger can be connected to the third after-cooler and can be configured to partially cool the third part of the air stream after having been further compressed. The turboexpander can then be connected between the higher pressure heat exchanger and the lower pressure column so as to turboexpand a third part of the air stream, thereby to form a refrigeration stream that is introduced into the lower pressure column.

In any embodiment of the present invention, a subcooler can be connected to the higher pressure column and the lower pressure column to subcool a crude liquid oxygen stream composed of liquid column bottoms of the higher pressure column and a nitrogen-rich liquid stream composed of liquefied nitrogen column overhead of the higher pressure column through indirect heat exchange with the waste nitrogen stream and a nitrogen-rich vapor stream composed of column overhead of the lower pressure column. The lower pressure column is also connected to the subcooler to receive at least part of the crude liquid oxygen stream and at least part of the nitrogen-rich liquid stream. Expansion valves located between the lower pressure column and the subcooler expand the at least part of the crude liquid oxygen stream and the at least part of the nitrogen-rich liquid stream. The lower pressure heat exchanger is connected to the subcooler to receive the nitrogen-rich vapor stream as one of the return streams.

Alternatively, the lower pressure heat exchanger can be connected to the higher pressure column and is configured to subcool the crude liquid oxygen stream composed of liquid column bottoms of the higher pressure column and the nitrogen-rich liquid stream composed of liquefied nitrogen column overhead of the higher pressure column. In such case, the lower pressure column is connected to the lower pressure heat exchanger so that part of the crude liquid oxygen stream and at least part of the nitrogen-rich liquid stream are introduced into the lower pressure column.

A nitrogen-rich liquid stream can be a first nitrogen-rich liquid stream. A pump can be connected between the higher pressure column and the higher pressure heat exchanger to pressurize a second nitrogen-rich liquid stream composed of liquefied nitrogen column overhead of the higher pressure column. The second nitrogen-rich liquid stream is vaporized within the higher pressure heat exchanger.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

Figure 1:
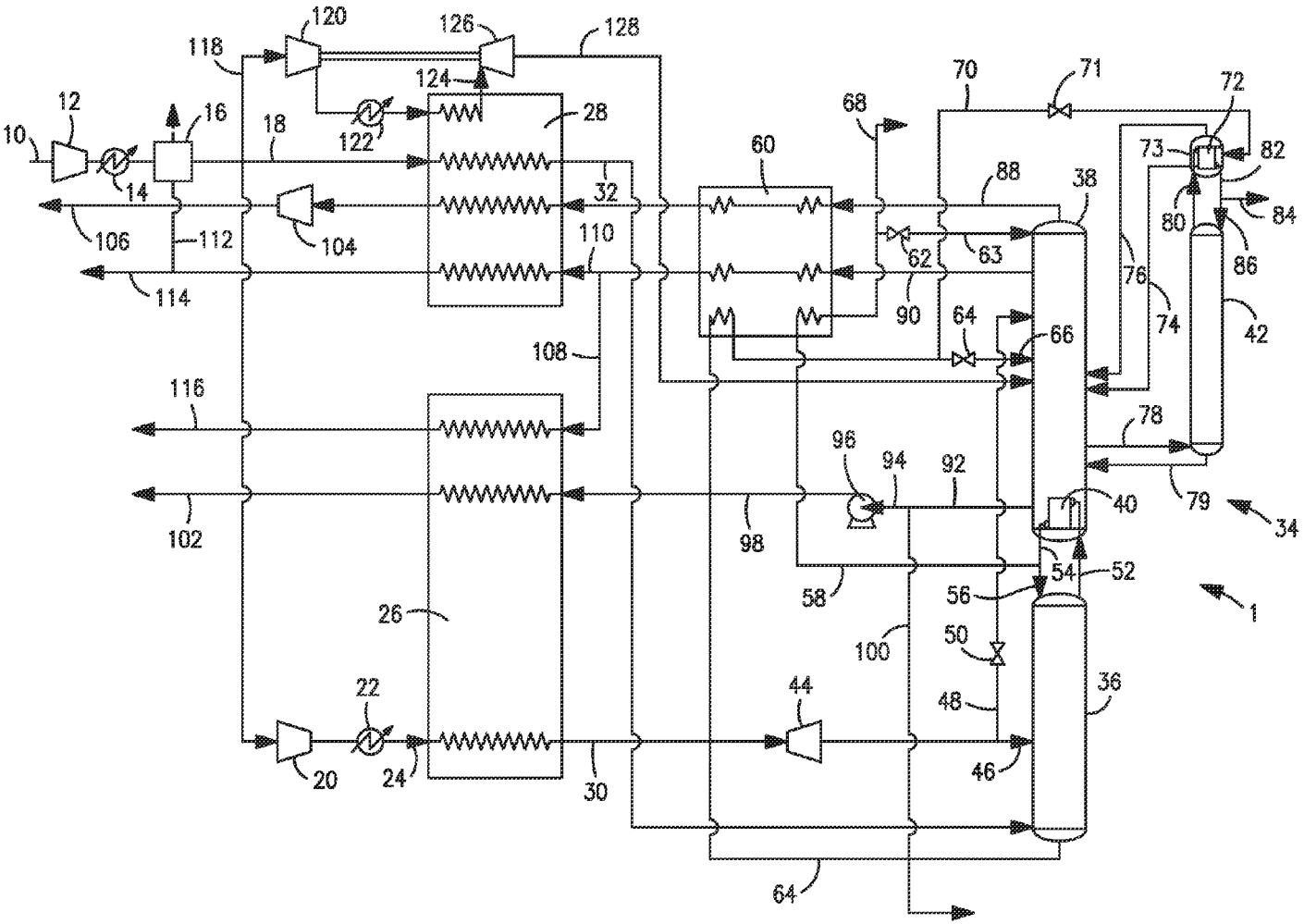
FIG. 1 is a schematic process flow diagram of an apparatus utilizing and carrying out a method in accordance with the present invention.
Figure 2:
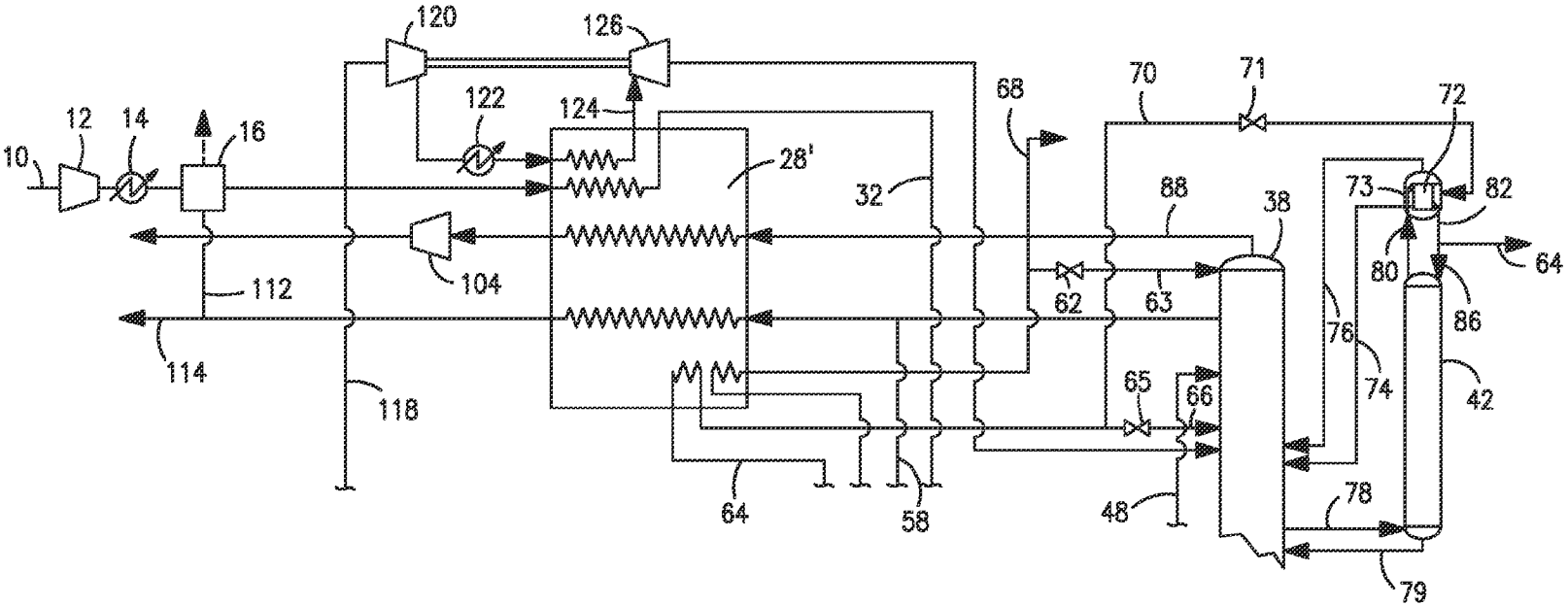
FIG. 2 is a schematic, fragmentary view of an alternative embodiment of the apparatus illustrated in FIG. 1 that is modified by incorporating a subcooling unit into a lower pressure heat exchanger in accordance with the present invention.
Figure 3:
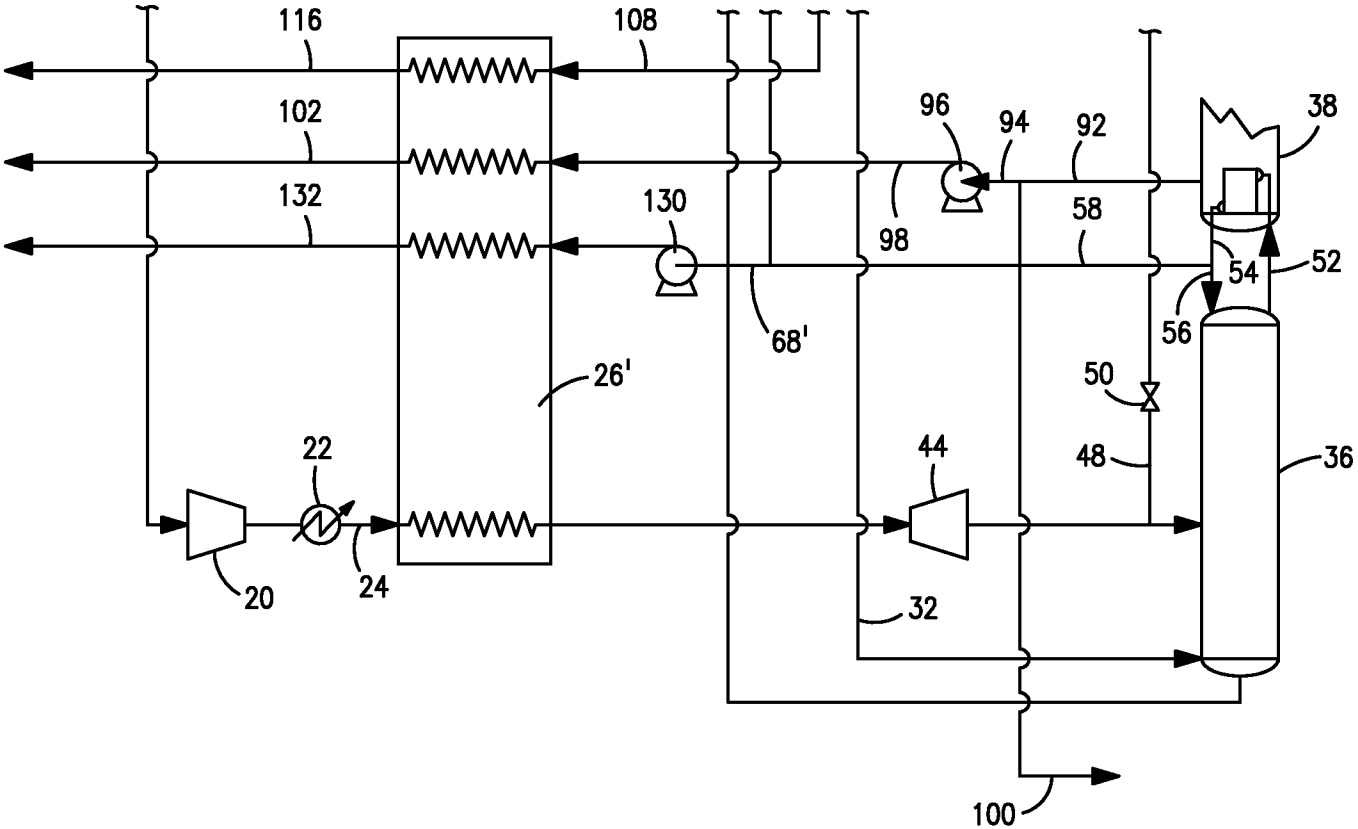
FIG. 3 is a schematic, fragmentary view of an alternative embodiment of the apparatus illustrated in FIG. 1 that also incorporates the alternative of FIG. 2 and that provides for production of a high pressure nitrogen product.
Figure 4:
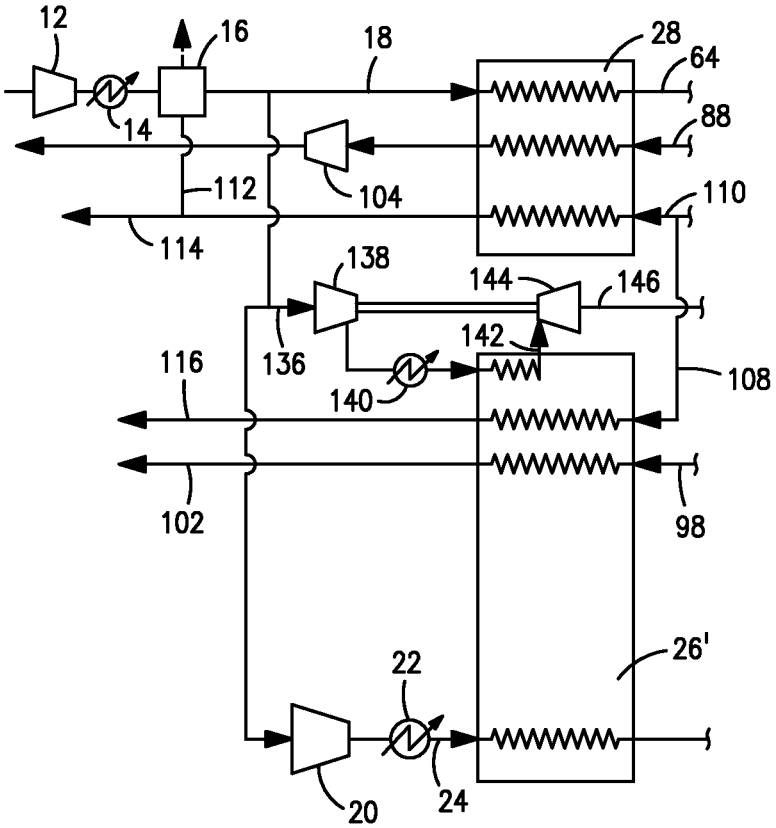
FIG. 4 is a schematic, fragmentary view of an alternative embodiment of the apparatus illustrated in FIG. 1 illustrating an alternative arrangement for providing refrigeration.

The portions of FIGS. 2, 3 and 4 that are not shown in the illustrations are the same as shown in FIG. 1.

DETAILED DESCRIPTION

With reference to FIG. 1, an apparatus 1 in accordance with the present invention is illustrated.

An air stream 10 is compressed in a main air compressor 12. After removal of the heat of compression by a first after-cooler 14, air stream 10 is purified within a purification unit 16. Purification unit 16, as well known to those skilled in the art can contain beds of adsorbent, for example alumina or carbon molecular sieve-type adsorbent to adsorb the higher boiling impurities contained within the air and therefore air stream 10. For example such higher boiling impurities as well known would include water vapor and carbon dioxide that could tend to freeze and accumulate at the low rectification temperatures contemplated by apparatus 1. In addition, hydrocarbons can also be adsorbed that could collect within oxygen-rich liquids and thereby present a safety hazard. A first compressed and purified air stream 18 is produced from a first part of air stream 10 after having been compressed, cooled and purified. A booster compressor 20 is in flow communication with purification unit 16 to compress a second part of the air stream after having been compressed, cooled and purified and a second after-cooler 22 is provided that is connected to booster compressor 20 to remove the heat of compression from the second part of air stream 10. This forms a second compressed and purified air stream 24 having a higher pressure than the first compressed and purified air stream 18.

It is to be noted that main air compressor 10 and booster compressor 20 are shown as single units. However, as is known in the art, two or more compressors can be installed in parallel to form either the main air compressor 10 or the booster compressor 20. Such compressor can be of equal size, however, unequal sizes in which capacity is split can be used, for example a split of 70/30 or 60/40.

A higher pressure heat exchanger 26 is connected to second after-cooler 24 and a lower pressure heat exchanger 28 is in flow communication with purification unit 16 to receive the first compressed and purified air stream 18. Both the higher pressure heat exchanger 26 and the lower pressure heat exchanger 28 are preferably of brazed aluminum construction and consist of layers of parting sheets separated by side bars to produce flow passages for the streams to be heated and cooled. Each of the flow passages are provided with fins as well known in the art to enhance the surface area for heat transfer within said heat exchangers. In this regard, the higher pressure heat exchanger 26 is configured to cool the second compressed and purified air stream 24 to produce a high pressure air stream 30 and the lower pressure heat exchanger 28 is configured to cool a first compressed and purified air stream to produce a main feed air stream 32. The high pressure air stream 30 is either in a liquid or dense phase state. As can be appreciated, other types of heat exchangers could be used, for example, such as spiral wound, printed circuit and stainless steel plate-fin heat exchangers. Moreover, although each of the higher pressure heat exchanger 26 and the lower pressure heat exchanger 28 are illustrated as single units, in practice, each could consist of several heat exchangers linked together in parallel.

The lower pressure heat exchanger will have a larger cross-sectional area for flow and a large total volume than the higher pressure heat exchanger 26. Typically the average density of the higher pressure heat exchanger 26 will be greater than the lower pressure heat exchanger 28 where density is the empty weight divided by volume. A typical density is about 1000 $kg/m^3$. A typical working pressure of the higher pressure heat exchanger is about 1200 psig and greater.

An air separation unit 34 is provided that has a higher pressure column 36 operatively associated with a lower pressure column 38 in a heat transfer relationship by means of a condenser-reboiler 40. Optionally, as illustrated, air separation unit 34 also includes an argon column 42 that is connected to low pressure column 38 for producing an argon product. It is understood however that argon column 42 is optional and the present invention has applicability to an air separation unit consisting solely of the higher pressure column 36 and the lower pressure column 38. It is understood that each of the higher pressure column 36, lower pressure column 38 and argon column 42 contain liquid-vapor mass transfer elements such as sieve trays or packing, either random or structured. Such elements as well known in the art enhance liquid-vapor contact of liquid and vapor phases of the mixture to be separated in each of such columns for rectification purposes.

High pressure air stream 30 is expanded to a pressure suitable for its introduction into higher pressure column 36 by way of a liquid turboexpander 44. Energy from liquid turboexpander 44 can be recovered. Alternatively, an expansion valve can be used. After having been expanded, high pressure air stream 30 is divided into a first subsidiary expanded stream 46 and a second subsidiary expanded stream 48. It is understood that typically first and second subsidiary expanded air stream 46 and 48 are two phase streams. Second subsidiary expanded stream 48 is expanded by an expansion valve 50 to pressure suitable for its introduction into lower pressure column 38. Thus, both first and second subsidiary expanded streams 46 and 48 are introduced into intermediate locations of higher and lower pressure columns 36 and 38, respectively at points thereof that would match the composition of the mixture being separated in the columns. It is understood, however, that embodiments of the present invention are possible in which the higher pressure air stream 30 is introduced into either the higher pressure column 36 or the lower pressure column 38.

The rectification of the air within higher pressure column 36 produces a crude liquid oxygen column bottoms and a nitrogen-rich vapor column overhead. A nitrogen-rich vapor column overhead stream 52 is condensed in condenser-reboiler 40 against vaporizing an oxygen-rich column bottoms that is produced by the rectification occurring in the lower pressure column. In this regard, such rectification also produces, within lower pressure column 38, a nitrogen-rich vapor column overhead. The resultant condensation produces a nitrogen-rich liquid stream 54. First part 56 of nitrogen-rich liquid stream 54 is returned to higher pressure column 36 as reflux. A second part 58 is subcooled within a subcooling unit 60, expanded within an expansion valve 62 to a pressure suitable for its introduction to lower pressure column 38 and then introduced into lower pressure column 38 as reflux. A crude liquid oxygen stream 64 is also subcooled within subcooling unit 60, expanded in an expansion valve 64 and a first part 66 thereof is introduced into lower pressure column 38 for further refinement. Additionally, a first part 63 of the nitrogen-rich liquid stream is introduced into lower pressure column 38. As illustrated, a second part 68 of the nitrogen-rich liquid stream after having been subcooled can be taken as a product stream. Also, a second part 70 of crude liquid oxygen stream 64 is expanded in an expansion valve 71 and then partially vaporized within an argon condenser 72 contained within a shell 73. Liquid and vapor fractions of second part 70 of crude liquid oxygen stream 64 designated by reference numerals 74 and 76, respectively are reintroduced into the lower pressure column 38.

At a suitable point within lower pressure column 38, an argon-rich stream 78 is withdrawn and rectified within an argon column 42 to produce an argon-rich vapor stream 80 that is condensed within argon condenser 73 to produce an argon-rich liquid stream 82. A first part 84 of argon-rich stream 82 can be taken as an argon product stream and a second part 86 thereof can be returned to argon column 42 as reflux.

A nitrogen vapor product stream 88 can be removed from the top of lower pressure column 38 and a waste nitrogen stream 90 can be removed below the top of low pressure column 38 in order to maintain the purity of nitrogen product stream 88. Nitrogen product stream 88 and crude nitrogen stream 90 then partially warmed within subcooling units 60 in order to subcool crude liquid oxygen stream 64 and nitrogen-rich liquid stream 58. Additionally, a liquid oxygen stream 92 composed of the oxygen-rich liquid column bottoms of lower pressure column 38 can be removed therefrom. The first part 94 of liquid oxygen stream 92 can be pressurized by a pump 96 to produce a pumped liquid oxygen stream 98 and a second part 100 of liquid oxygen stream 92 can optionally be taken as a product. Pumped liquid oxygen stream 98, nitrogen product stream 88 and in a manner to be discussed, crude waste nitrogen stream 90 constitutes return streams of the air separation unit 34 that are used to cool the incoming air within higher pressure heat exchanger 26 and lower pressure heat exchanger 28. Pumped liquid oxygen stream 98 is vaporized within higher pressure heat exchanger 26 to produce a high pressure oxygen product stream 102. Nitrogen product stream 88 after having been partially warmed within subcooling unit 60 is introduced into lower pressure heat exchanger 28 and then optionally compressed with a compressor 104 to produce a nitrogen vapor product stream 106.

After partially warming with subcooling unit 60, waste nitrogen stream 90 is divided into a first subsidiary waste nitrogen stream 108 and a second subsidiary waste nitrogen stream 110. First subsidiary waste nitrogen stream 108 and second subsidiary waste nitrogen stream 110 are introduced into higher and lower pressure heat exchangers 26 and 28, respectively, for thermal balancing purposes such as have been described above. Advantageously, second subsidiary waste nitrogen stream 110, after having traversed lower pressure heat exchanger 28, can be divided into first and second portions 112 and 114. Portion 112 can be utilized to regenerate the adsorbent within purification unit 16 in a manner known in the art and second subsidiary waste nitrogen stream 108 is fully warmed and discharged as a waste nitrogen stream 116. As described above, thermal balancing is required in order to minimize the temperature difference between the return streams and the air streams within lower pressure heat exchanger 28 at the warm end thereof, namely, second subsidiary waste nitrogen stream 110, product nitrogen stream 88 and incoming first compressed and purified air stream 18 to eliminate warm end refrigeration losses at lower pressure heat exchanger 28. Low pressure air stream 32 and high pressure air stream 30 will be similar temperatures such that the temperature difference between pumped liquid oxygen stream 98 and high pressure air stream 30 must is optimized. If the temperature of high pressure air stream 30 is too high, upon expansion thereof within liquid turboexpander 40 or an expansion valve, too much vapor will evolve and will not produce the desired distillation.

As also mentioned above, higher pressure heat exchanger 26 and lower pressure heat exchanger 28 are preferably of brazed aluminum design. Higher pressure heat exchanger 26, given its high pressure environment, will require thicker parting sheets and side bars and high fabrication costs. In order to decrease the fabrication costs, yet perform the thermal balancing function, cross-sectional flow area for first subsidiary waste nitrogen stream 108 is sized such that first subsidiary waste nitrogen stream 108 undergoes a higher pressure drop and therefore, the warm waste nitrogen stream 116 is at a lower pressure than first and second parts 112 and 114 of fully warmed second subsidiary waste nitrogen stream 110. The cross-sectional flow area is selected such that the pressure drop within the higher pressure heat exchanger 26 of first subsidiary waste nitrogen stream 108 is greater than that would otherwise have been required to produce the pressure drop of second subsidiary waste nitrogen stream 110 within lower pressure heat exchanger 28. Given the fact that first part 112 of fully warmed second subsidiary waste nitrogen stream 110 has not undergone a great pressure drop, it can be utilized to regenerate the absorbent within prepurification unit 16.

As described above and as well known in the art, plate-fin heat exchangers have a layered construction in which each of the streams, for example the incoming air stream, the nitrogen-rich stream and etc. pass through separate layers that are arranged in a pattern to efficiently conduct indirect heat exchange between the streams. The layered construction is produced in such heat exchangers by a series of parallel parting plates and peripheral side bars to seal the layers along their edges. Manifolds are provided to feed the streams into the layers. An arrangement of fins is provided in each of the layers that increase the area available for the heat exchange. In the preferred embodiment, the cross-sectional flow area of the higher pressure heat exchanger 26 is reduced by manipulating the number of layers therewithin. As a result, higher pressure heat exchanger 26 is of lower height than it otherwise would have been had the pressure drop within first subsidiary waste nitrogen stream 108 and second subsidiary waste nitrogen stream 110 been equal. Nonetheless, the higher velocity of stream 108 through high pressure heat exchanger 26 enables the necessary heat transfer to be accomplished due to dramatically improved heat transfer coefficients. Similarly, for a spiral wound heat exchanger the increased velocity will result in the necessary heat transfer being accomplished with a smaller number of tubes for the first subsidiary waste nitrogen stream. The whole unit will therefore be smaller and require less material.

A printed circuit-type heat exchanger is similar to a plate-fin heat exchanger in that it is constructed from a number of layers. A higher velocity of the first subsidiary nitrogen stream will result in a higher pressure drop for the same heat transfer, but at the expense of fewer layers and therefore a cheaper heat exchanger.

As well known in the art, any cryogenic rectification plant must be refrigerated in order to overcome warm end heat exchange losses. In air separation plant 1, a third part 118 of the compressed and purified air stream 10 after having been compressed, cooled and purified is then further compressed within a booster compressor 120 and then cooled within a third after-cooler 122. After partially cooling within lower pressure heat exchanger 28, the resultant partially cooled stream 124 can be introduced into a turboexpander 126 to produce a refrigeration stream 128 as an exhaust. Refrigeration stream 128 is introduced into lower pressure column 38.

With reference to FIG. 2 a lower pressure heat exchanger 28' is illustrated that is an alternative embodiment to lower pressure heat exchanger 28 shown in FIG. 1. In lower pressure heat exchanger 28', the subcooling unit 60 has been eliminated and incorporated into the lower pressure heat exchanger 28'. The resultant method and apparatus is much the same as that described with respect to air separation plant 1. However, the main air stream 32 is withdrawn at an intermediate location of lower pressure heat exchanger 28' given the lower cold end temperatures that result from the elimination of the subcooling unit 60.

With reference to FIG. 3, an alternative embodiment of the air separation plant shown in FIG. 1 and as modified in FIG. 2 is to produce a high pressure nitrogen product stream by pumping a first part 68' of the nitrogen-rich liquid stream within a pump 130 and then vaporizing the pumped nitrogen stream to produce a high pressure nitrogen vapor stream 132 within higher pressure heat exchanger 26' that is provided with passages for such purpose. As can be appreciated, the air separation column of FIG. 3 would in all other respects be similar to the air separation plant shown in FIG. 2. Moreover, a product nitrogen stream 68 could be taken as illustrated in FIGS. 1 and 2.

With reference to FIG. 4, a third part 136 of air stream 10 after having been compressed, cooled and purified can be compressed in a booster compressor 138 and cooled within a third after-cooler 140 to remove the heat of compression and is then partly cooled within a higher pressure heat exchanger 26' having passages provided for such purpose. The resulting partially cooled stream 142 can be expanded within a turboexpander 144 to produce a refrigerant stream 146 from the exhaust thereof. Refrigerant stream 146 can be introduced into the lower pressure column 38. In all other respects, the embodiment shown in FIG. 4 can be the same as that illustrated in FIG. 1. The following table summarizes a calculated example for a process in accordance with the present invention that is conducted with the apparatus shown in FIG. 3.

| Stream No. | Flow | Temperature, K | Pressure, psia | Composition | Percent vapor |
|---|---|---|---|---|---|
| *10 | 5036 | 285.9 | 87.6 | Air | 100 |
| 18 | 2875 | 285.9 | 87.6 | Air | 100 |
| 24 | 1623 | 308.2 | 1600 | Air | 100 |
| 32 | 2875 | 102.1 | 84.2 | Air | 100 |
| 30 | 1623 | 99.1 | 1597 | Air | 0 |
| 46 | 454 | 96.7 | 83.7 | Air | 0 |
| **48 | 1169 | 81.5 | 19.1 | Air | 15.8 |
| 124 | 538 | 183.8 | 161.0 | Air | 100 |
| 128 | 538 | 108.9 | 19.5 | Air | 100 |
| 68 | 21.7 | 80.8 | 80.9 | 99.9995% $N_2$ + Ar | 0 |
| 84 | 34.2 | 88.5 | 16.8 | 99.9997% Ar | 0 |
| 100 | 29.4 | 93.7 | 20.9 | 99.6% $O_2$ | 0 |
| 102 | 1000 | 304.1 | 1266 | 99.6% $O_2$ | 100 |
| 110 | 2293 | 79.8 | 18.5 | 98.6% $N_2$ | 100 |
| ***110 | 2293 | 286.9 | 16.5 | 98.6% $N_2$ | 100 |
| 108 | 416 | 79.8 | 18.5 | 98.6% $N_2$ | 100 |
| 116 | 416 | 304.1 | 15.5 | 98.6% $N_2$ | 100 |
| ****88 | 1000 | 286.9 | 16.2 | 99.9995% $N_2$ + Ar | 100 |
| 132 | 241 | 304.1 | 175 | 99.9995% $N_2$ + Ar | 100 |

*10: Air stream 10 after having been compressed in main air compressor 12 and purified within purification unit 16.
**48: Second subsidiary expanded stream 48 after passage through valve 50.
***110: Second subsidiary waste nitrogen stream 110 after passage through lower pressure heat exchanger 28
****88: Nitrogen vapor product stream after passage through lower pressure heat exchanger 28.

While the present invention has been described with reference to preferred embodiments, as will occur to those skilled in the art, numerous changes and additions and omissions can be made without departing from the spirit and the scope of the present invention that set forth in the presently pending claims.

We claim:

1. A method of separating air comprising:

producing a first compressed and purified air stream and a second compressed and purified air stream having a higher pressure than the first compressed and purified air stream;

cooling the first compressed and purified air stream and the second compressed and purified air stream in a lower pressure heat exchanger and a higher pressure heat exchanger, respectively, through indirect heat exchange with return streams generated in an air separation unit, thereby to produce a main feed air stream and a high pressure air stream, either in a liquid or dense phase fluid state; introducing the main feed air stream into a higher pressure column of the air separation unit, expanding the high pressure air stream and introducing at least part of the high pressure air stream into at least one of a lower pressure column and a high pressure column of the air separation unit;

the return streams comprising at least part of a pumped liquid oxygen stream composed of a liquid oxygen column bottoms of the lower pressure column that is introduced into the higher pressure heat exchanger and vaporized and first and second subsidiary waste nitrogen streams, formed from a waste nitrogen stream removed from the lower pressure column, that are introduced into the higher pressure heat exchanger and the lower pressure heat exchanger, respectively, for thermal balance purposes; and the higher and lower pressure heat exchangers being configured such that the first subsidiary waste nitrogen stream undergoes a higher pressure drop in the higher pressure heat exchanger than the second subsidiary waste nitrogen stream undergoes in the lower pressure heat exchanger by passing the first subsidiary waste nitrogen stream through a cross-sectional flow area within the higher pressure heat exchanger that is sized to produce the higher pressure drop.

2. The method of claim 1, wherein:

an air stream is compressed, cooled and purified, the air stream being purified in a purification unit having an adsorbent to adsorb higher boiling impurities in the air stream;

the first compressed and purified air stream is formed from a first part of the air stream after having been compressed, cooled and purified;

the second compressed and purified air stream is formed by further compressing and cooling a second part of the air stream after having been compressed, cooled and purified; and the adsorbent in the purification unit is regenerated with the second of the first and second waste nitrogen streams after having passed through the lower pressure heat exchanger.

3. The method of claim 2, wherein:

a third part of the air stream after having been compressed, cooled and purified is further compressed and cooled and partially cooled within the lower pressure heat exchanger and then, turboexpanded within a turboexpander to generate a refrigeration stream; and the refrigeration stream is introduced into the lower pressure column.

4. The method of claim 2, wherein:

a third part of the air stream after having been compressed, cooled and purified is further compressed and cooled and partially cooled within the higher pressure heat exchanger and then, turboexpanded within a turboexpander to generate a refrigeration stream; and the refrigeration stream is introduced into the lower pressure column.

5. The method of claim 1 or claim 2 or claim 3 or claim 4, wherein:

a crude liquid oxygen stream composed of liquid column bottoms of the higher pressure column and a nitrogen-rich liquid stream composed of liquefied nitrogen column overhead of the higher pressure column are subcooled through indirect heat exchange with the waste nitrogen stream and a nitrogen-rich vapor stream composed of column overhead of the lower pressure column;

at least part of the crude liquid oxygen stream and at least part of the nitrogen-rich liquid stream are expanded and introduced into the lower pressure column; and the nitrogen-rich vapor stream is introduced into the lower pressure heat exchanger as one of the return streams.

6. The method of claim 3, wherein:

a crude liquid oxygen stream composed of liquid column bottoms of the higher pressure column and a nitrogen-rich liquid stream composed of liquefied nitrogen column overhead of the higher pressure column are subcooled within the lower pressure heat exchanger;

at least part of the crude liquid oxygen stream and at least part of the nitrogen-rich liquid stream are expanded and introduced into the lower pressure column; and the nitrogen-rich vapor stream is introduced into the lower pressure heat exchanger as one of the return streams.

7. The method of claim 6, wherein:

the nitrogen-rich liquid stream is a first nitrogen-rich liquid stream; and a second nitrogen-rich liquid stream composed of liquefied nitrogen column overhead of the higher pressure column is pumped and vaporized within the higher pressure heat exchanger.

8. An air separation apparatus comprising:

a main air compressor, a first after-cooler and a purification unit to compress, cool and purify an air stream, thereby to produce a first compressed and purified air stream from a first part of the air stream after having been compressed, cooled and purified;

a booster compressor in flow communication with the purification unit to further compress a second part of the air stream after having been compressed, cooled and purified and a second after-cooler connected to the booster compressor to cool the second part of the air stream, thereby to form a second compressed and purified air stream having a higher pressure than the first compressed and purified air stream;

a higher pressure heat exchanger and a lower pressure heat exchanger connected to the second after-cooler and in flow communication with the purification unit, respectively;

the lower pressure heat exchanger and the higher pressure heat exchanger configured to cool the first compressed and purified air stream and the second compressed and purified air stream, respectively, through indirect heat exchange with return streams generated in an air separation unit, thereby to produce a main feed air stream and a high pressure air stream in either a liquid or dense phase fluid state;

the air separation unit comprising a higher pressure column connected to the lower pressure heat exchanger to receive the main feed air stream and a lower pressure column connected to the higher pressure heat exchanger by an expansion device to receive at least part of the high pressure air stream;

a pump to pressurize a liquid oxygen stream composed of a liquid oxygen column bottoms of the lower pressure column, the pump connected to the higher pressure heat exchanger so that the liquid oxygen stream after having been pumped is introduced into the higher pressure heat exchanger and vaporized;

the higher pressure heat exchanger and the lower pressure heat exchanger also in flow communication with the lower pressure column to receive first and second subsidiary waste nitrogen streams, respectively, formed from a waste nitrogen stream removed from the lower pressure column, for thermal balance purposes; and the higher pressure heat exchanger being configured such that a cross-sectional flow area for flow of the first subsidiary waste nitrogen stream exists within the higher pressure heat exchanger that is sized to produce a higher pressure drop in the first subsidiary waste nitrogen stream than a pressure drop of the second subsidiary waste nitrogen stream flowing through the lower pressure heat exchanger.

9. The air separation apparatus of claim 8, wherein:

the purification unit has an adsorbent to adsorb higher boiling impurities in the air stream; and the purification unit is connected to the lower pressure heat exchanger so as to receive the second of the first and second waste nitrogen streams after having passed through the lower pressure heat exchanger to regenerate the adsorbent.

10. The air separation apparatus of claim 9, wherein:

a further booster compressor is also in flow communication with the purification unit to further compress a third part of the air stream and a third after-cooler is connected to the further booster compressor;

the lower pressure heat exchanger is connected to the further booster compressor and is configured to partially cool the third part of the air stream after having been further compressed; and a turboexpander is connected between the lower pressure heat exchanger and the lower pressure column so as to turboexpand the third part of the air stream, thereby to form a refrigeration stream and to introduce the refrigeration stream into the lower pressure column.

11. The air separation apparatus of claim 9, wherein:

a further booster compressor is also in flow communication with the purification unit to further compress a third part of the air stream and a third after-cooler is connected to the further booster compressor;

the higher pressure heat exchanger is connected to the further booster compressor and is configured to partially cool the third part of the air stream after having been further compressed; and a turboexpander is connected between the higher pressure heat exchanger and the lower pressure column so as to turboexpand the third part of the air stream, thereby to form a refrigeration stream and to introduce the refrigeration stream into the lower pressure column.

12. The air separation apparatus of claim 8 or claim 9 or claim 10 or claim 11 wherein:

a subcooler connected to the higher pressure column and the lower pressure column to subcool a crude liquid oxygen stream composed of liquid column bottoms of the higher pressure column and a nitrogen-rich liquid stream composed of liquefied nitrogen column overhead of the higher pressure column through indirect heat exchange with the waste nitrogen stream and a nitrogen-rich vapor stream composed of column overhead of the lower pressure column;

the lower pressure column also connected to the subcooler to receive at least part of the crude liquid oxygen stream and at least part of the nitrogen-rich liquid stream;

expansion valves located between the lower pressure column and the subcooler to expand the at least part of the crude liquid oxygen stream and the at least part of the nitrogen-rich liquid stream; and the lower pressure heat exchanger is connected to the subcooler to receive the nitrogen-rich vapor stream as one of the return streams.

13. The air separation apparatus of claim 10, wherein:

the lower pressure heat exchanger is connected to the higher pressure column and is configured to subcool a crude liquid oxygen stream composed of liquid column bottoms of the higher pressure column and a nitrogen-rich liquid stream composed of liquefied nitrogen column overhead of the higher pressure column;

the lower pressure column connected to the lower pressure heat exchanger so that at least part of the crude liquid oxygen stream and at least part of the nitrogen-rich liquid stream are introduced into the lower pressure column;

expansion valves are located between the lower pressure column and the lower pressure heat exchanger to expand the at least part of the crude liquid oxygen stream and the at least part of the nitrogen-rich liquid stream; and the lower pressure heat exchanger is connected to the lower pressure column so that the nitrogen-rich vapor stream is introduced into the lower pressure heat exchanger as one of the return streams.

14. The air separation apparatus of claim 13, wherein:

the nitrogen-rich liquid stream is a first nitrogen-rich liquid stream; and a pump is connected between the higher pressure column and the higher pressure heat exchanger to pressurize a second nitrogen-rich liquid stream composed of liquefied nitrogen column overhead of the higher pressure column and to vaporize the second nitrogen-rich liquid stream within the higher pressure heat exchanger.

* * * * *